United States Patent [19]

Krauss et al.

[11] 4,369,948

[45] Jan. 25, 1983

[54] DISAPPEARING BOOK HOLDER

[76] Inventors: Leonard Krauss; Halina Krauss, both of 4204 Melisa Ct., Carmichael, Calif. 95608

[21] Appl. No.: 147,377

[22] Filed: May 7, 1980

[51] Int. Cl.[3] ..... A47B 63/06; A47B 77/10

[52] U.S. Cl. ..... 248/441 A; 108/32; 248/293; 248/447; 248/456

[58] Field of Search ..... 248/293, 441 A, 441 B, 248/447, 454, 456; 108/28, 32, 99

[56] References Cited

U.S. PATENT DOCUMENTS

| | | | |
|---|---|---|---|
| 259,390 | 6/1882 | Hensley | 108/32 X |
| 573,089 | 12/1896 | Haynes | 108/32 |
| 1,412,630 | 4/1922 | Richard | 108/99 |
| 1,746,792 | 2/1930 | Rastetter | 248/293 |
| 1,942,340 | 1/1934 | Madden | 248/456 |
| 3,762,675 | 10/1973 | Sankey | 248/441 A UX |
| 3,838,841 | 10/1974 | Cadman | 248/293 X |
| 4,109,889 | 8/1978 | Durket | 248/447 |
| 4,184,725 | 1/1980 | Spangler | 248/447 X |

FOREIGN PATENT DOCUMENTS

| | | | |
|---|---|---|---|
| 663644 | 8/1938 | Fed. Rep. of Germany | 108/32 |
| 2241964 | 3/1975 | France | 248/441 A |

*Primary Examiner*—W. Carter Reynolds

*Attorney, Agent, or Firm*—Harvey B. Jacobson

[57] ABSTRACT

A book holder for attachment to kitchen cabinets, shelves and the like and adapted for permanent mounting thereon includes a pivotally mounted book supporting portion which can be extended forward and below the leading edge of the cabinet or shelf without occupying table or counter space and which can be moved into a concealed position and stored beneath the cabinet. The book holder further includes an adjustable support arm which can change the angle of the book supporting portion when extended.

3 Claims, 4 Drawing Figures

FIG. 1
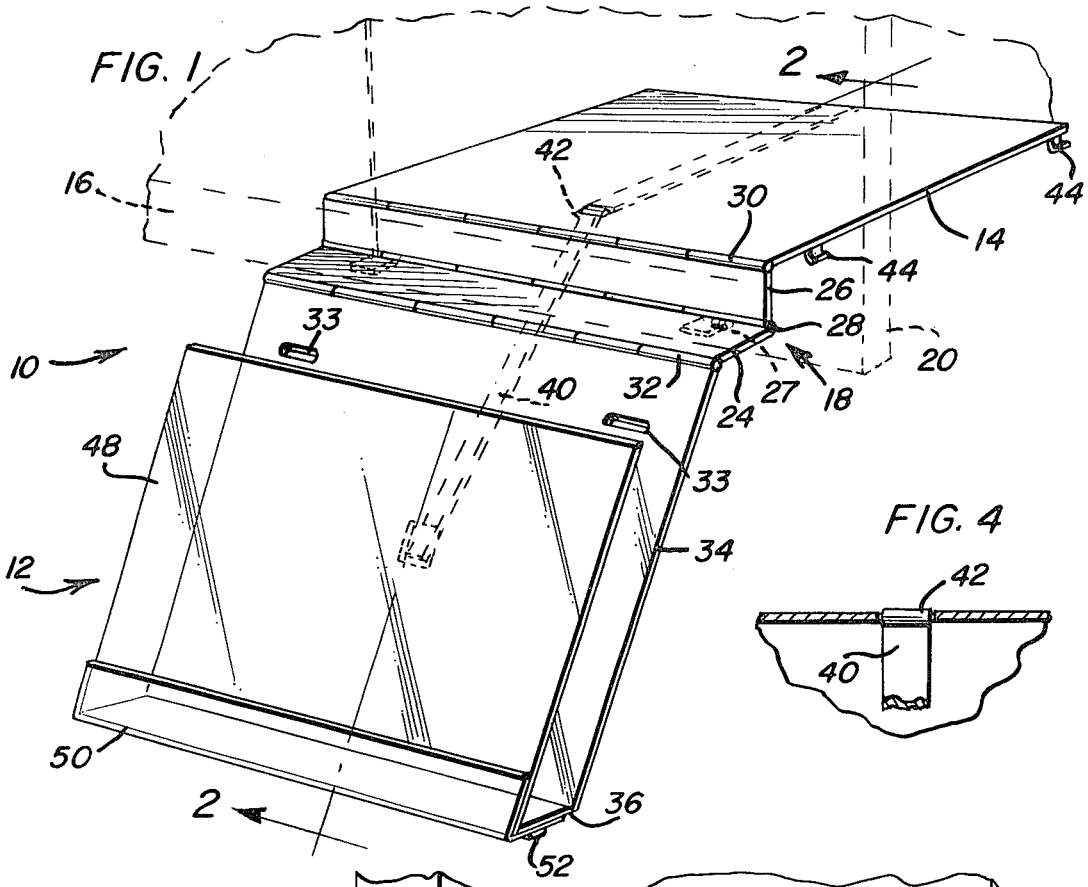
FIG. 4
FIG. 2
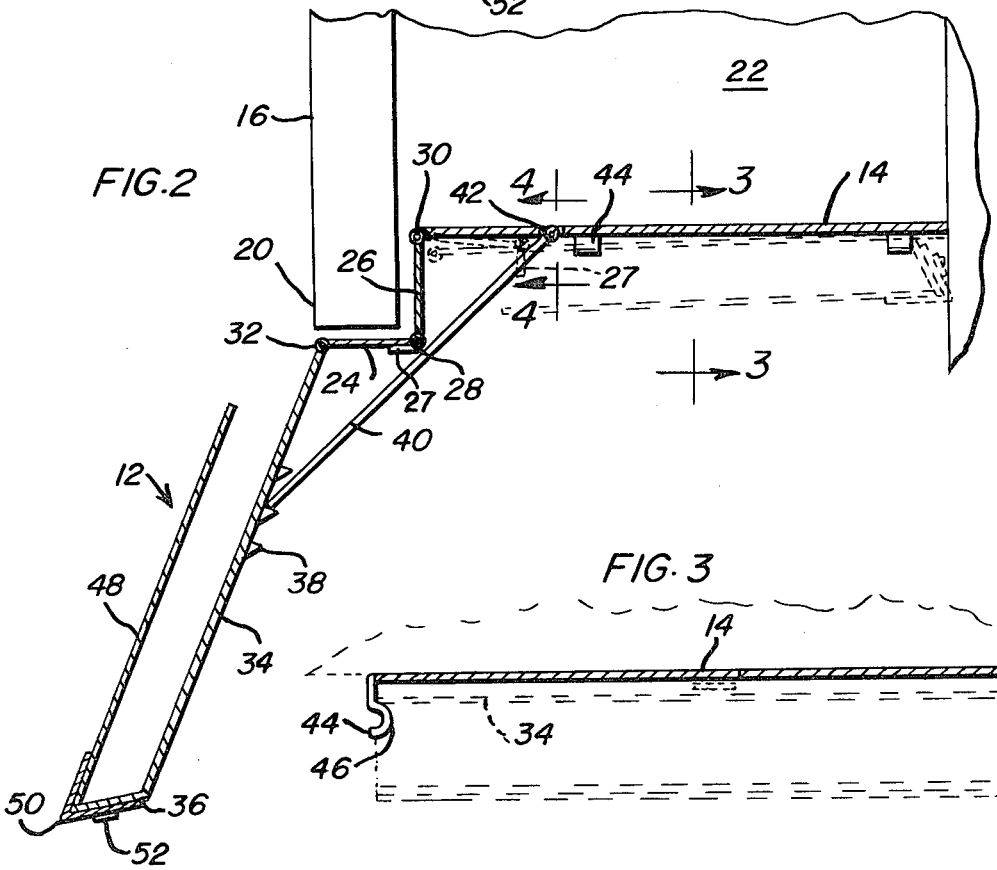
FIG. 3
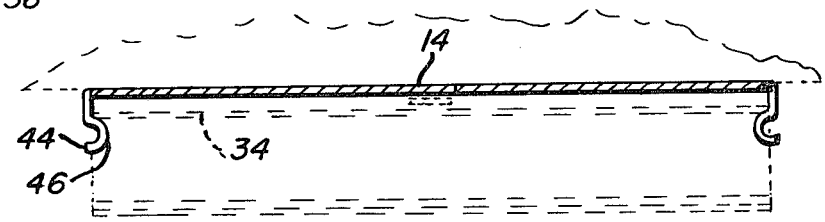

DISAPPEARING BOOK HOLDER

BACKGROUND OF THE INVENTION

1. Field of the Invention

This invention relates to book holders and more particularly to a book holder for supporting a book below and forward of the support surface to which it is permanently attached, such as a kitchen cabinet or shelf in which the book supporting portion can also be pivoted and stored into a concealed position conveniently beneath the support surface. The book supporting portion can be extended below and forward of the support surface to a convenient viewing level without occupying table or counter space.

2. Disclosure Statement

Many types and kinds of book holders have been developed for use on tabletops and the like for supporting an open book in a position to be readable by a person seated at such table or desk. For example, U.S. Pat. No. 4,109,889, issued Aug. 29, 1978 to Durket, U.S. Pat. No. 2,612,721, issued Oct. 7, 1952 to Pollard, and U.S. Pat. No. 324,234, issued Aug. 11, 1885 to Cole, all disclose book holders for desks in which the book supporting portion is stored below the desk top and pivotally mounted so that it can be moved above the desk top for supporting the book in an open position to be readable by a person seated at the desk. All three of these patents teach book holders which occupy a portion of the desk top space. Book holders for supporting or storage of books below a chair are taught in U.S. Pat. No. 3,180,680. issued Apr. 27, 1965 to Landvik, and U.S. Pat. No. 3,584,915, issued June 15, 1971 to Meyers. Further, a cookbook holder is known which is portable and can be suspended behind the center post of an upper kitchen cabinet. This cookbook holder is not permanently secured below the kitchen cabinet for out of the way storage and does not include the pivotally mounted book support portion included in the book holder of the present invention.

SUMMARY OF THE INVENTION

The present invention provides for a book holder including a book support portion which can be positioned in a downwardly inclined relation below the bottom front edge of a kitchen cabinet, or the like, and is pivotally mounted so that it can also be swung to a concealed position underneath the cabinet, the book supporting portion being securely locked in both of its positions. In its extended position, the book supporting portion can support an open book at a convenient viewing level without occupying table or counter space and be inclined at several angles by an adjustable supporting arm which supports and locks the book support portion. In the concealed position the book support portion is locked by retaining means placed on attachment means for the book holder.

Accordingly, it is an object of the present invention to provide a book holder which can be suspended from a support surface and support a book in an open position without occupying table or counter space.

It is a further object of the invention to provide a book holder which can be secured to a support surface and support a book in an open position and yet be concealed adjacent the support surface when not in use.

It is another object of the invention to provide a book holder including a book supporting portion which can be extended in a downwardly inclined position relative to the bottom front edge of a support surface and is pivotally mounted to a base portion secured to the support surface and which can be swung to a concealed position adjacent the support surface, the book supporting portion being securely locked in both of its positions.

It is still yet another object of the present invention to provide a book holder including a book supporting portion which can be extended to a plurality of inclined positions below the bottom front edge of a kitchen cabinet or the like, and swung to a concealed position beneath the cabinet, the book supporting portion being securely locked in all its extended and concealed positions.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the book holder of the present invention in which book the supporting portion is in its extended position below and in front of the leading edge of a kitchen cabinet illustrated by the dashed lines.

FIG. 2 is a cross-sectional view of the book holder taken generally along line 2—2 of FIG. 1, the dash lines representing the folded or concealed position of the book supporting portion.

FIG. 3 is a transverse sectional view of the book holder including the base attachment means and the mechanism for locking the book supporting portion in its concealed position.

FIG. 4 is a transverse sectional view of the book holder taken generally along line 4—4 of FIG. 2 and illustrating the adjustable support arm of the book holder which can adjust the angle to which the book supporting portion is inclined.

DETAILED DESCRIPTION OF THE INVENTION

Referring to the drawings and in particular to FIGS. 1 and 2, the book holder of the present invention designated by the numeral 10 includes book supporting portion 12 and support frame member or base attachment bracket 14 which secures book holder 12 to the underside of cabinet 16, or the like. Base 14 can be permanently attached to cabinet 16 by any fastening means, e.g., screws, adhesive, etc. An important feature of the present invention is the ability of book holder 10 to be secured to a cabinet 16, such as a kitchen cabinet and support a book in open position at a convenient viewing level for the user without occupying any counter or table space which may be needed as for food preparation.

Book support portion 12 is pivotally mounted on base 14 to pivot between a concealed position shown by the dashed lines in FIG. 2 and the extended position. While the mounting means provided for the pivotal movement of book support 12 can be a wide variety of known structures, a preferable structure comprises a double hinge arrangement designated by the numeral 18. Double hinge 18 is particularly useful when securing book holder 10 to kitchen cabinets which usually comprise a depending front edge portion 20 extending from the undersurface such that the front leading edge portion 20 extends below body portion 22 of kitchen cabinet 16. The double hinge arrangement enables book support 12 to extend below front edge portion 20 and yet fold into the concealed position shown in FIG. 2. Double hinge 18 comprises articulated pivot members or two hinge plates 24 and 26 pivotally connected by a standard roll hinge 28. Hinge plate 26 is pivotal about standard roll hinge 30 connecting hinge plate 26 with base 14. Hinge plate 26 contains tabs 27 extending therefrom at a right angle and located at roll hinge 28, tabs 27, preferably two in number enabling hinge plate 24 to rest at a right angle to hinge plate 26 when book support 12 is in its extended position. Book support 12 is pivotable about roll hinge 32 connecting book support 12 with hinge plate 24.

Book support 12 comprises book back support 34 and forwardly extending ledge or shelf 36. Back support 34 and shelf 36 are preferably formed into a unitary structure. A series of extensions, grooves or stops 38 are placed on the back surface of back support 34 to hold adjustable support arm 40 pivotal about hinge 42. Hinge 42 also secures adjustable support arm 40 to base attachment bracket 14. The plurality of stops 38 enables book suport 12 to be locked into a variety of inclined positions by adjustable support arm 40. The concealed or storage position of support arm 40 is shown by the dashed line in FIG. 2. In the concealed position, book support 12 is locked adjacent the underside of the support surface such as cabinet 16 by a plurality of retaining tabs 44. Retaining tabs 44 formed of a pliable plastic or metal material expand outward as they are contacted by book support 12 during placement in the concealed position until book support 12 is pushed beyond inward convex edge 46 as shown in FIG. 3, whereupon book support 12 is firmly locked into a resting position between retaining tabs 44. Slots 33 formed in back support 32 receive tabs 27 when book support 12 is in the concealed position.

Book support 12 also includes a protective removable transparent front panel 48 spaced from back support 34 to enable the placement of a book therebetween. Front panel 48 is supported by an L-shaped bracket 50 attached to bottom ledge 36 by a fastening means 52 such as a screw. Bracket 50 enables transparent front panel 48 to be removed for cleaning and adjusted so that book support 12 can accommodate larger books.

As can be seen from the above description and the drawings, book holder 10 can be attached to the bottom of a shelf and support books, cards, papers, etc. at a convenient height and angle without occupying table or counter space or obstructing the use of the shelf or cabinet from which the book holder is attached. The permanent attachment of the book holder, its ease of use, and its ability to be pivoted from a locked and concealed position to a substantially vertical position below and forward of the support surface to which it is attached including obstacles such as vertical extending surfaces, make the book holder 10 of the present invention a substantial improvement over prior art book holding devices.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A book holder able to support a book in a substantially vertical orientation comprising means to attach said book holder to a support surface, book support means pivotally mounted on said attachment means for supporting said book in said substantially vertical orientation positioned below and forward of said surface, means to lock said book support means in at least one of a plurality of inclined positions below and forward of said surface, said book support means including a book back support and a book shelf attached to a lower end of said back support and said means to lock said book support means including an adjustable support arm pivotally mounted on said attachment means and able to engage one of a plurality of extensions placed on the surface of said back support, said attachment means being capable of securing the book holder underneath said support surface, said book support means being pivotal about said attachment means to a horizontal position adjacent and below said surface, said attachment means further including a retaining means to lock said book support means in said horizontal position, said book support means being pivotal about said attachment means by a double hinge plate attachment which supports said book support means in said substantially vertical orientation and which is able to be folded underneath and adjacent said support surface when said book support means is in said horizontal position.

2. The book holder of claim 1 wherein said book support means includes a transparent front panel secured to said book shelf and spaced from said back support.

3. The book holder of claim 2 wherein said book support means includes a fastening means to removably secure said transparent panel to said shelf.

* * * * *